United States Patent [19]

Cusenbary

[11] 4,092,042

[45] May 30, 1978

[54] TABLE AND SEAT CONSTRUCTION

[76] Inventor: Dan C. Cusenbary, Cunningham, Kans. 67035

[21] Appl. No.: 777,157

[22] Filed: Mar. 11, 1977

[51] Int. Cl.[2] ..... A47C 7/62

[52] U.S. Cl. ..... 297/157; 108/111; 108/153

[58] Field of Search ..... 108/150, 153, 154, 158, 108/111; 297/157; 248/188.7, 169, 171, 431, 164

[56] References Cited

U.S. PATENT DOCUMENTS

| | | | |
|---|---|---|---|
| 1,162,148 | 11/1915 | Dunlap | 108/154 |
| 2,722,971 | 11/1955 | Gallagher | 297/157 |
| 3,032,380 | 5/1962 | Danciart et al. | 108/154 |
| 3,120,405 | 2/1964 | Soszynski | 297/157 |
| 3,274,278 | 9/1966 | Haydock | 248/431 |
| 3,366,079 | 1/1968 | Koransky et al. | 248/431 X |
| 3,643,608 | 2/1972 | DeCesaris | 248/431 X |
| 3,662,980 | 5/1972 | Kantor | 248/188.7 |

FOREIGN PATENT DOCUMENTS

| | | | |
|---|---|---|---|
| 1,112,861 | 11/1955 | France | 297/157 |

*Primary Examiner*—James T. McCall
*Attorney, Agent, or Firm*—Edward L. Brown, Jr.

[57] ABSTRACT

A picnic table and seat structure having a table top and a plurality of tubular legs shaped in a pedestal form with the feet of the legs outwardly turned to support individual seats. The center sections of the legs are banded together around a center post which supports the table top and spreads the legs.

7 Claims, 6 Drawing Figures

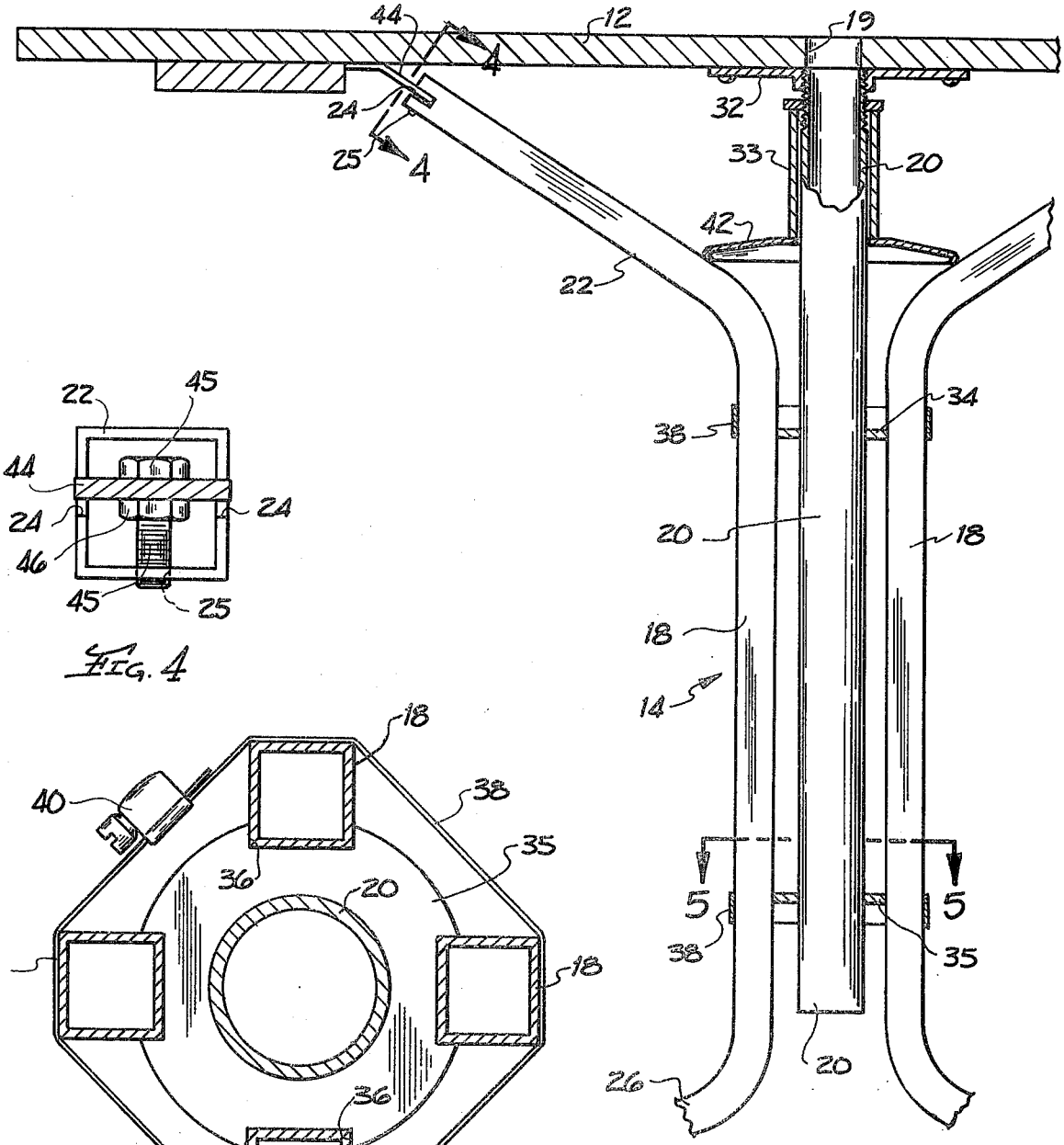
FIG. 3
FIG. 4
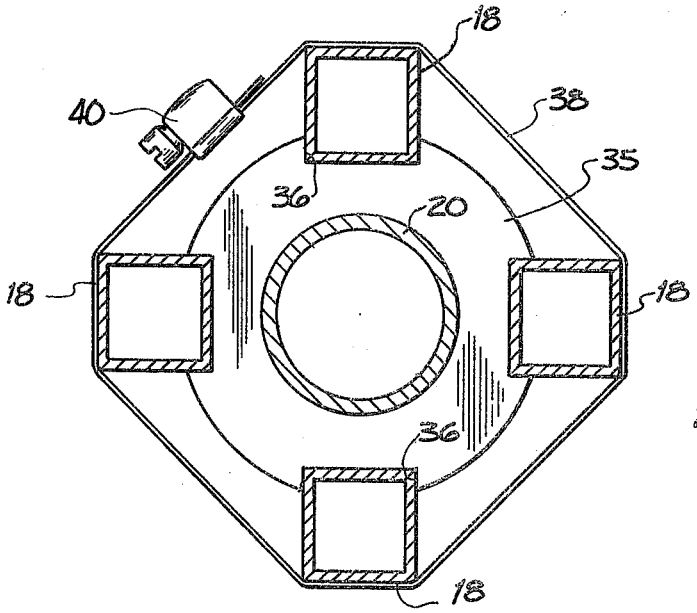
FIG. 5
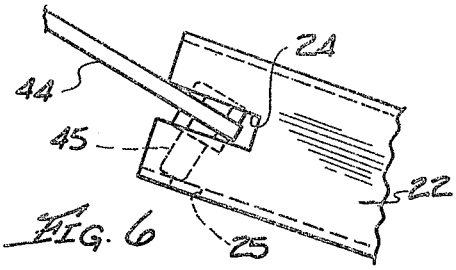
FIG. 6

TABLE AND SEAT CONSTRUCTION

BACKGROUND OF THE INVENTION

This invention relates to a table and seat construction specifically intended for outdoor picnic or patio use. An integrally constructed table and chair structure has its obvious advantages over tables with separate chairs. The commonly constructed picnic table comprises a rectangular table with long benches on both sides which require the users to climb over the bench in a rather awkward manner unless the person is sitting on the ends of the bench.

There are also numerous picnic table designs with the seats arranged radially around the periphery of the table such as U.S. Pat. Nos. 3,542,420 and 681,394. The concept of multiple legs arranged in a pedestal form with their lower ends radiating outward and supporting a stool thereon is well known, an example of which is shown in U.S. Pat. No. 3,572,824.

SUMMARY OF THE INVENTION

The present invention is an improvement on the above mentioned designs whereby a circular table top is supported by a tubular leg structure which is banded together with a center post in a pedestal form to rigidly support the table top at various points around its periphery and its center. The center post is surrounded by the legs, all of which are banded together to form a pedestal with the upper end of the center post attaching to the table top. The center post supports a threaded collar member which is screwed downwardly into contact with the upper portions of the legs forcing or prestressing the legs outward against the banding thereby increasing the entire table structure rigidity.

Another object of the invention is to provide a picnic table which is supported at its center and outward points around its periphery to minimize the table top deflection under load.

Another object of the present invention is to provide a simplified square cross section tubular leg structure which is prestressed to provide improved rigidity.

Other and further objects of the invention will become more apparent in the details of construction and operation of the unit as more fully described and claimed hereafter, reference being had to the accompanying drawings forming a parth hereof in which:

FIG. 3 is a partial section taken along lines 3 — 3 of FIG. 2 to an enlarged scale;

FIG. 4 is a section taken along lines 4 — 4 of FIG. 3 to an enlarged scale;

FIG. 5 is a sectional view taken along lines 5 — 5 of FIG. 3; and FIG. 6 is a partial elevational view of the leg.

Figure 1:
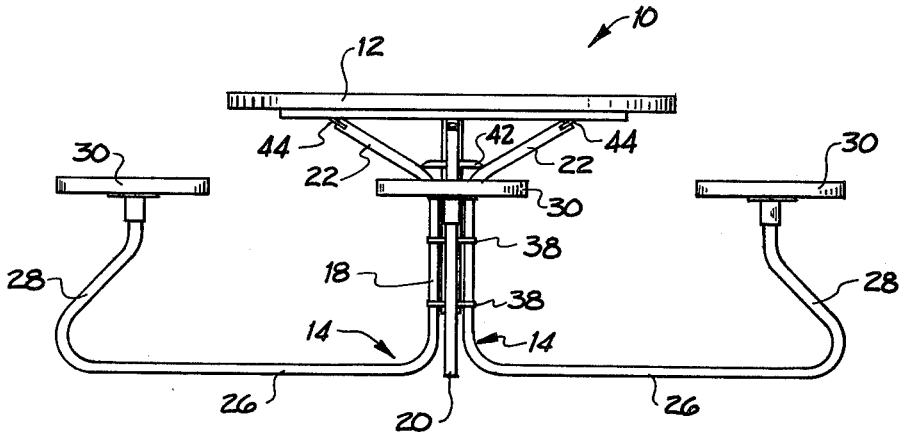
FIG. 1 is a side elevational view of the table and seat construction.
Figure 2:
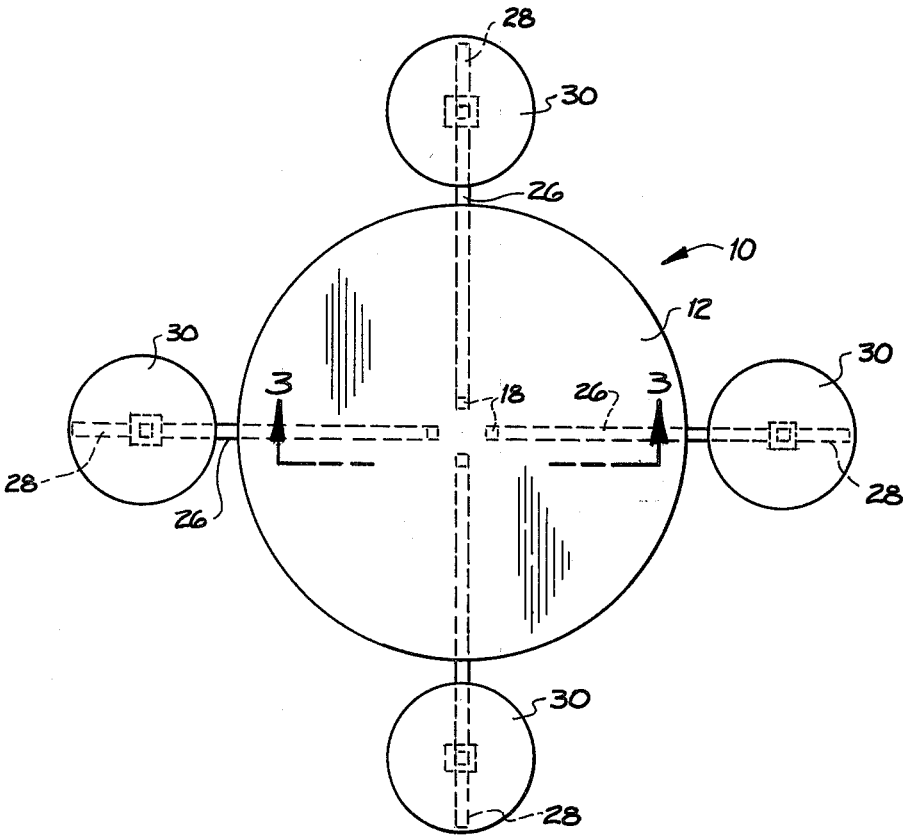
FIG. 2 is a top plan view.

Referring now more specifically to the drawings and particularly FIGS. 1 and 2, reference number 10 generally describes the table and seat structure defined by the present invention. The table unit 10 is made up of a table top 12 supportable by a plurality of tubular legs generally described by reference numeral 14. Legs 14 are constructed of steel tubing having a square cross section. Legs 14 include a vertical center section 18 which is banded together with center post 20 in the form of a pedestal. The upper ends of legs 14 have an outwardly spread section 22 which terminates in a mounting slot 24 and accompanying locking hole 25. The lower ends of legs 14 include a horizontally offset section 26 which extends outwardly from the center of the table and supports the table and seat structure on the resting surface. At the end of the offset section 26, the leg is upwardly turned and forms a seat support section 28 which in turn supports seat member 30 on the end thereof. Seat support section 28 has a return bend, as best seen in FIG. 1, so that the load placed on seat 30 is inwardly set from the outermost end of offset section 26. The affect of this shape tends to reduce the moment load on the leg 14 at the juncture between center section 18 and offset section 26 thereby giving a more stable structure under deflection. This in turn reduces the amount of deflection of offset section 26 and renders the overall table structure 10 more stable under load.

Centrally positioned between the leg center sections 18 is a center post 20 extending upwardly into contact with table top 12, as best seen in FIG. 3. Concentrically positioned on table top 12 is an opening 19 in concentric alignment with a threaded fitting 32 mounted to the underside of the table top 12. The upper end of center post 20 is threaded and sized for receipt in fitting 32 thereby providing an open passage down through the center post for receipt of a shade umbrella, not shown, or any other structure requiring support from the table. Positioned longitudinally along center post 20 are a pair of positioning rings 34 and 35 which are attached to center post 20 by welding or other means. Rings 35, as best seen in FIG. 5, include a group of four notches 36, quandrantally spaced around the periphery thereof for partial receipt of the leg center sections 18. The center post and legs are held together by steel bands 38. Band 38 is tensioned by a conventional screw threaded tightening member 40, not shown in detail in the drawing.

Threadably mounted on the upper end of center post 20 is a tightening sleeve 33 having an outwardly extending flange 42 normally in bearing contact with leg sections 22. Anchored to the underside of table top 12 are a plurality of leg mounting lugs 44 which extend downwardly from the table top undersurface at an approximate 45° angle, as best seen in FIG. 3. Located approximate the end of lug 44 is a bolt or pin 45 held in place on the lug by a retaining nut 46. Also a welded pin could be utilized. The upper end of table leg 14 includes an oversized slot 24 which loosely receives lug 44, as seen in FIGS. 4 and 6. Also located in the end of leg 14 adjacent slot 24, is a hole 25 for receipt of the end of bolt 45. Due to the width of slot 24, leg 14 can be rotated from its FIG. 3 position clockwise a sufficient angular distance so that the end of bolt 45 clears hole 25 and leg 14 can be removed from lug 44 (see FIG. 6).

METHOD OF ASSEMBLY

The table top 12 and its tubular leg members 14 in the broken down state can be boxed in a relatively small space for shipping as compared with its assembled configuration. To assemble the table unit 10, the top 12 is placed face down on the ground and each of the leg members 14 are positioned for engagement with lug members 44. To allow the end of bolt 45 to pass into the end of leg section 22, it is necessary to first rotate the leg approximately 30° counterclockwise from its FIG. 3 position. In this rotated position, lug 44 can be received in slot 24 due to the oversize of the slot which is clearly shown in FIG. 6. With the legs 14 in engagement with bolts 45 the legs are in position for banding around center post 20. With the center sections 18 of the legs positioned in notches 36 of ring 35, the legs are ready for banding by bands 38, tightened by members 40. Center post 20 is threadably attached to top 12. Sleeve member 33 threaded on center post 20 is now screwed downwardly until outer flange 42 comes in contact with leg sections 22. Tightening or prestressing in this manner tends to force the undersurface of the table top upward and the leg sections 22 outward. This slight deflection renders the overall leg structure 14 and table top 12 more rigid against all normal loads.

While the drawings show a circular table with a seating arrangement for four, this design has equal utility for a larger design of either six or eight seats. For example, in an eight-seat arrangement, the spacer rings 35 would have eight notches 36 in place of four, each being positioned at a 45° angle from the other. With an eight-seat arrangement, the proportional diameter of the table top 12 would be appreciably larger and also the center post 20.

The foregoing is considered as illustrative only for the principles of the invention and there are many features and parts that may be varied in form such as the table top shape, without department from the spirit of the invention.

Having thus described my invention with sufficient clarity to enable those familiar with the art to construct and use it, I claim:

1. A picnic table structure supported by a plurality of radially spaced legs comprising:

a table top having a center point;

mounting means on the underside of the table top radially positioned around the table top for detachable engagement with the legs;

a plurality of legs each leg having a vertical center section, an outwardly spread upper section and a horizontal lower section, the ends of the upper section engaging the table top mounting means;

individual seat means attached to the outer ends of the lower section of the legs;

a center post attached to the center point of the table top extending downwardly between the legs in adjacent side-by-side relation;

banding means surrounding and tightly restraining the center sections of the legs and the center post;

sleeve means on the center post adjustable longitudinally into contact with the upper sections urging the legs to spread against the banding means thereby causing a more rigid structure.

2. A picnic table structure as set forth in claim 1, wherein each leg is formed from metal tubular stock having a square cross section.

3. A picnic table structure as set forth in claim 1, wherein the center post is tubular, with the tube opening in alignment with an opening in the table top and the sleeve means being threadably supported on the outside of the center post.

4. A picnic table structure as set forth in claim 1, wherein the table includes at least four legs, each formed from square cross section tubular stock, and the center post includes at least four notches equally spaced around its periphery, shaped for snug receipt of the leg center sections.

5. A picnic table structure as set forth in claim 1, wherein the outer end of the horizontal lower section of the leg includes a section that is turned upwardly and inwardly to a point where the seat means is attached.

6. A picnic table structure as set forth in claim 1, wherein the mounting means includes a plurality of lugs extending downwardly from the underside of the table top, each lug having a pin extending laterally through the end of the lug and the end of each upper leg section including a slot for receipt of said lugs and a hole for receipt of said pins.

7. A picnic table structure as set forth in claim 1, wherein the mounting means includes a plurality of lugs extending downwardly from the underside of the table top, each lug having a pin extending laterally through the end of the lug and the end of each upper leg section including a slot for receipt of said lugs and a hole for receipt of said pins, each of the lugs being positioned inwardly from the periphery of the table top an equal distance.

* * * * *